United States Patent [19]

Kobayashi

[11] Patent Number: 4,877,212

[45] Date of Patent: Oct. 31, 1989

[54] DOCUMENT STAND

[75] Inventor: Mitsuo Kobayashi, Kawasaki, Japan

[73] Assignee: Nippo Kabushiki Kaisha, Yokohama, Japan

[21] Appl. No.: 267,633

[22] Filed: Oct. 31, 1988

Related U.S. Application Data

[63] Continuation of Ser. No. 80,177, Jul. 31, 1987, abandoned, which is a continuation of Ser. No. 835,719, Mar. 3, 1986, abandoned.

[30] Foreign Application Priority Data

Mar. 2, 1985 [JP] Japan ..... 60-65826[U]

[51] Int. Cl.[4] ..... B41J 11/02

[52] U.S. Cl. ..... 248/444.1; 248/442.2; 248/454; 40/341; 400/718

[58] Field of Search ..... 248/441.1, 444.1, 442.2

[56] References Cited

U.S. PATENT DOCUMENTS

| | | | |
|---|---|---|---|
| 1,811,118 | 6/1931 | Fischer | 248/442.2 |
| 1,908,874 | 5/1933 | Van Alstine | 248/441.1 X |
| 2,097,419 | 10/1937 | Schmidt | 40/10 A |
| 2,574,575 | 11/1951 | MacIntyre | 248/422.2 X |
| 3,328,899 | 7/1967 | Stewart | 40/10 A X |
| 3,533,178 | 10/1970 | Strohmaier | 40/10 A |
| 3,774,603 | 11/1973 | McPhee | 40/10 D X |
| 3,863,882 | 2/1975 | Hatcher | 248/441.1 X |
| 3,908,297 | 9/1975 | Schmutzler et al. | 40/352 X |
| 3,918,635 | 11/1975 | Gilomen | 40/10 D X |
| 4,144,664 | 3/1979 | De Korte | 40/10 D X |
| 4,159,836 | 7/1979 | Tarr | 40/352 X |
| 4,242,817 | 1/1981 | Ballard | 40/10 D X |
| 4,267,656 | 5/1981 | Solomon | 40/352 |
| 4,582,285 | 4/1986 | Bello | 248/442.2 |

FOREIGN PATENT DOCUMENTS

| | | | |
|---|---|---|---|
| 626781 | 7/1949 | United Kingdom | 248/441.1 |

*Primary Examiner*—Alvin C. Chin-Shue

*Attorney, Agent, or Firm*—Armstrong, Nikaido, Marmelstein, Kubovcik & Murray

[57] ABSTRACT

Disclosed is a document stand, wherein guide lines with varying colors or patterns for facilitating the reading of rows of letters or characters are provided on a transparent plate disposed in front of a main plate, so as to prevent misreading or omission of a portion of a document, without the need to use a guide rod or the like as a ruler.

4 Claims, 2 Drawing Sheets

DOCUMENT STAND

This application is a continuation of application Ser. No. 080,177 filed July 31, 1987 now abandoned which is a continuation application of Ser. No. 835,719 filed on Mar. 3, 1986 now abandoned.

BACKGROUND OF THE INVENTION

The present invention relates to a document stand for use in compiling documents employing a word processor or the like.

A conventional document stand used for a typewriter or the like is composed of a single metallic plate having a support at the lower end thereof. In addition, a slim guide rod with a magnet or a guide plate with a slide guide is used for pressing a desired portion of a document.

However, since word processors, which have come to be used widely in recent years, are not provided with a document stand, an operator is compelled to operate a word processor while looking at related documents placed on a desk or to operate it with one hand while holding the document with the other. Consequently, there is a possibility that the operator may misread or omit a portion of the document to be input.

SUMMARY OF THE INVENTION

Accordingly, an object of the present invention is to provide a document stand which is capable of eliminating the aforementioned drawbacks and allows the content of a document to be input smoothly without encouraging mistakes.

To attain the aforementioned object, the present invention provides a document stand comprising a main plate, a transparent plate erected in front of said main plate with a space for insertion of a document therebetween, and a document accommodating support which is communicated with the lower ends of the main plate and the transparent plate, several rows of guide lines with varying colors or patterns being provided on the transparent plate at fixed intervals and in parallel with each other.

BRIEF DESCRIPTION OF THE DRAWINGS

The drawings illustrate one embodiment of a document stand relating to the present invention, in which.

DETAILED DESCRIPTION OF THE PREFERRED EMBODIMENTS

Figure 1:
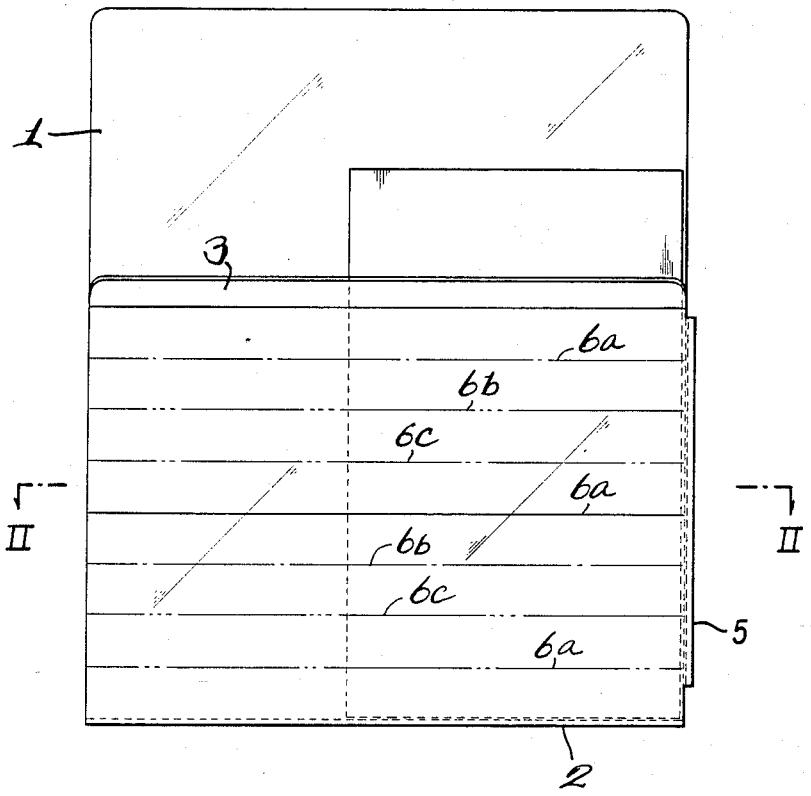
FIG. 1 is a front elevational view of the invention.
Figure 2:
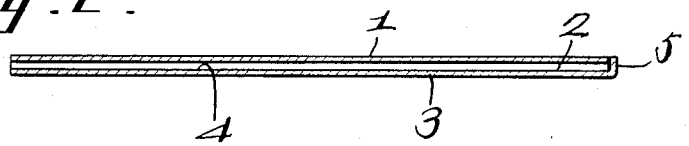
FIG. 2 is a cross-sectional view taken along the line II—II of FIG. 1.

Referring now to the drawings, an embodiment of the present invention will be described hereinunder. In the drawings, reference numeral 1 denotes a transparent main plate made of synthetic resin, the transparent main plate 1 being formed integrally with a support 2 disposed at the lower end thereof and a transparent plate 3 extending from the end of the support 2 in such a manner as to be parallel with the main plate 1, thereby forming an insertion space 4 between the main plate 1 and the transparent plate 3 capable of accommodating a document therein. The document inserted into the insertion space 4 is held and stabilized by the support 2.

Guide lines *6a*, *6b*, and *6c* in different colors are disposed at fixed intervals on the transparent plate 3 in such a manner as to be horizontal and parallel with each other.

Figure 3:
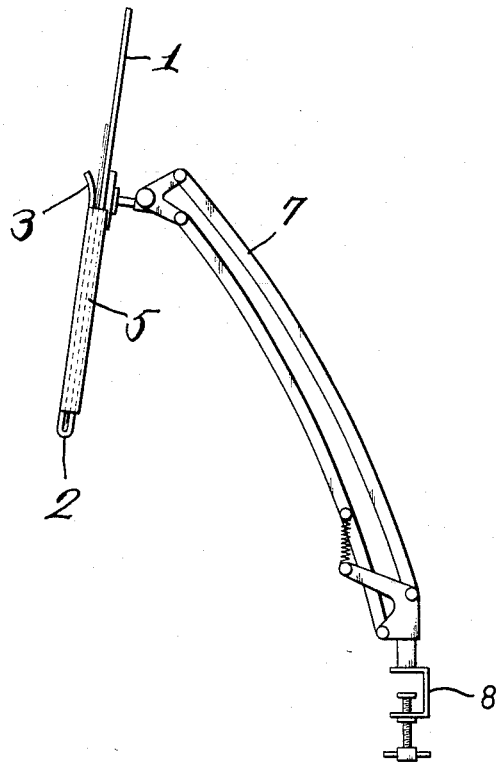
FIG. 3 is a side elevational view illustrating the position in which the document stand is used.

In addition, the main plate 1 is provided with another support 5 on the right-hand edge thereof, as viewed in FIG. 1, so that the guide lines can be set vertically if the main plate 1 is inclined sideways by 90 degrees. This feature has been incorporated into the design so that the document stand may be conveniently used for Japanese-style documents as well in which sentences are written vertically. Incidentally, reference numeral 7 in FIG. 3 is a support arm installed so that the main plate 1 can be rotated to a position at which the main plate 1 can be most conveniently used. The support arm 7 is fixed to a table or the like by means of an installation fitting 8 provided at the lower end of the support arm 7.

According to the present invention, a document is stabilized by means of the transparent plate, and the portion of the document to be read can be clearly identified by virtue of the guide lines with varying colors or patterns, so that misreading or omission can be substantially avoided.

What is claimed is:

1. A document stand for a word processor or the like comprising;

a. a main rectangular plate having a first side edge and a first bottom edge;

b. a transparent rectangular plate having a second side edge and a second bottom edge, said first and second bottom edges being connected to form a first document support, said first and second side edges being connected to form a second document support, and said transparent plate being connected in stationary spaced relation to said main plate solely by said first and second document supports such that remaining non-connected two sides of each of said main plate and said transparent plate form an L-shaped opening to allow a document to be inserted therethrough in a predetermined fixed relationship with respect to at least one of said first and second document supports, said main rectangular plate and said transparent rectangular plate forming a document holder;

c. a plurality of stationary reference indica fixed on a substantially whole surface of said transparent plate, each of said plurality of stationary reference indicia being in parallel to said first document support and vertical to said second document support to emphasize a plurality of sentences on said document and to prevent misreading or omission of a portion of said sentences of said document; and d. a support arm to hold said document holder in a variety of positions as desired such that said document holder can be rotated, wherein said first document support being adapted to work as bottom support for a document in which said sentences are printed horizontally and said second document support being adapted to work as a bottom support for a document in which said sentences are printed vertically.

2. The document stand of claim 1, wherein said plurality of stationary reference indicia is a plurality of lines.

3. The document stand of clam 1, wherein said plurality of stationary reference indicia has varying colors.

4. The document stand of claim 1, wherein said main plate is larger than said transparent plate.

* * * * *

UNITED STATES PATENT AND TRADEMARK OFFICE

CERTIFICATE OF CORRECTION

PATENT NO. : 4,877,212

DATED : October 31, 1989

INVENTOR(S) : Mitsuo KOBAYASHI

It is certified that error appears in the above-identified patent and that said Letters Patent is hereby corrected as shown below:

On the cover page, Item [30], "Mar. 2, 1985" should read --May 2, 1985--.

Signed and Sealed this

First Day of January, 1991

*Attest:*

HARRY F. MANBECK, JR.

*Attesting Officer*

*Commissioner of Patents and Trademarks*